US007802735B2

(12) United States Patent
Liu et al.

(10) Patent No.: US 7,802,735 B2
(45) Date of Patent: Sep. 28, 2010

(54) REFRIGERANT FLOATING EXPANSION APPARATUS

(75) Inventors: Chia-Hung Liu, Hsinchu County (TW); Chung-Che Liu, Hsinchu (TW); Shih-Chang Chiang, Hsinchu County (TW); Hsu-Cheng Chiang, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 452 days.

(21) Appl. No.: 12/045,732

(22) Filed: Mar. 11, 2008

(65) Prior Publication Data

US 2009/0158763 A1 Jun. 25, 2009

(30) Foreign Application Priority Data

Dec. 19, 2007 (TW) ..... 96148808 A

(51) Int. Cl.
*G05D 23/12* (2006.01)
*F16K 31/16* (2006.01)

(52) U.S. Cl. ..... 236/92 B; 62/218; 137/432

(58) Field of Classification Search ..... 62/218, 62/219, 220, 222; 236/92 B; 137/192, 409, 137/430, 432
See application file for complete search history.

(56) References Cited

U.S. PATENT DOCUMENTS 4,633,681 A 1/1987 Webber
5,009,079 A 4/1991 Zinsmeyer
5,285,653 A 2/1994 Meloling et al.
5,417,078 A * 5/1995 Huenniger et al. ..... 62/218
5,692,389 A * 12/1997 Lord et al. ..... 62/222

FOREIGN PATENT DOCUMENTS

CN 2308784 Y 2/1999
CN 2572149 Y 9/2003
TW M276185 9/2005

* cited by examiner

*Primary Examiner*—Marc E Norman
(74) *Attorney, Agent, or Firm*—Thomas, Kayden, HOrstemeyer & Risley

(57) ABSTRACT

A refrigerant floating expansion apparatus including a main body, a standpipe, a float element and a separation element is provided. The main body includes a base plate and a pipe-shaped housing. The standpipe fixed on the base plate has a second pipe opening and a third pipe opening. The pipe wall of the standpipe has at least an opening near the second pipe opening. The float element surrounds the standpipe for controlling a fluid-passing area of the opening. The separation element surrounding the float element is disposed on the base plate and forms an inner path with the pipe-shaped housing. The separation element has several fluid passageways near the base plate. A high-pressure fluid entering the main body is guided to pass through the fluid passageways to move the float element for controlling the fluid-passing area of the opening. Then, the high-pressure fluid is transferred to a low-pressure fluid.

20 Claims, 8 Drawing Sheets

REFRIGERANT FLOATING EXPANSION APPARATUS

This application claims the benefit of Taiwan application Serial No. 96148808, filed Dec. 19, 2007 the subject matter of which is incorporated herein by reference.

BACKGROUND OF THE INVENTION

1. Field of the Invention

The invention relates in general to a refrigerant expansion apparatus, and more particularly to a refrigerant floating expansion apparatus.

2. Description of the Related Art

Refrigeration and air-conditioning system has become a necessity to people in their everyday life. Particularly as industrialization is highly developed, the need for large-sized refrigerating/air-conditioning system increases accordingly. However, the large-sized refrigerating/air-conditioning system lacks of preferred expansion apparatuses. As the refrigeration system is now systematized and new technologies such as multi-stage adjustment and variable speed driven compressor are adopted, manufacturers are even more in need of suitable expansion apparatuses.

Along with the development of the refrigeration system, various types of expansion apparatus such as orifice expansion apparatus, short tube expansion apparatus, thermal expansion apparatus, and electronic expansion apparatus are provided. However, these expansion apparatuses have respective restrictions. For example, the orifice expansion apparatus and short tube expansion apparatus are applicable to most refrigeration systems but only have a fixed pressure drop mechanism and the expansion ability can not be adjusted according to system loads, therefore refrigeration systems adopting such types of expansion apparatus have poor performance in terms of stability, energy saving and cost in maintenance and repair. Thermal expansion apparatus and electronic expansion apparatus are most expensive as compared to the previous ones; particularly the electronic expansion apparatus is in the highest price among all types of expansion apparatus. Moreover, the thermal or electronic expansion apparatus can only be applied to a refrigeration system with small load, and a plurality of the thermal or electronic expansion apparatuses must be connected in serial or parallel if the system load is large, hence incurring higher manufacturing cost and complexity of the system.

Refrigerant expansion apparatus is one of the four main apparatuses (compression apparatus, condensing apparatus, evaporation apparatus and expansion apparatus) in a refrigeration system, and the types of the expansion apparatus is selected according to the type and capacity of the system. For example, a medium or small-sized refrigeration system always adopts thermal expansion apparatus or electronic expansion apparatus. Due to the type and cost of refrigerant, the two expansion apparatus only provide up to 500 refrigeration tons. The refrigeration system above 500 refrigeration tons uses the orifice or floating expansion apparatus because the two expansion apparatuses are not restricted by the types of refrigerant and the capacity of refrigeration system.

As disclosed in Taiwanese Patent Publication No. M276185 "Modified Structure For Control Valve Of Refrigerant Float Ball", the modified structure includes a control valve set and a float ball component. By controlling the vertical position of the float ball, a valve is enabled to open or close. The valve is in U-shaped, and the refrigerant entrance hole is symmetric with the valve seat, so that the flow of the refrigerant supply is controlled. The float ball and the valve seat are linked by a lever. The size of the refrigerant entrance hole is adjusted by the floating power and leverage of the float ball. However, as the floating power of the float ball is hard to control and the float ball may drift with the refrigerant, the valve seat is thus difficult to maintain at the middle position. Consequently, the supply flow of the refrigerant is affected and the valve seat may even be engaged.

According to American Patent Publication No. U.S. Pat. No. 5,285,653 "Refrigerant Flow Control Device", the size of the opening on the standpipe is controlled when a float surrounding the standpipe moves up and down. Gas is infused into the underneath of the float via an air passageway for controlling the height of float. Meanwhile, there is a mesh surrounding the float for allowing the fluid to pass through. However, such apparatus controls the volume of gas entering the passageway by way of a control valve, making the apparatus more complicated.

American Patent Publication No. U.S. Pat. No. 5,009,079 "Refrigerant Flow Control Device" also controls the size of the opening on the standpipe when the float surrounding the standpipe moves up and down. In the operation procedure of the apparatus, if the float of the apparatus falls to the bottom of the standpipe, the float will completely cover the opening of the standpipe. Before the next operation of the apparatus starts, a large force must be applied to the float to lift the float for exposing the opening of the standpipe to restore the flow.

SUMMARY OF THE INVENTION

The invention is directed to a refrigerant floating expansion apparatus applicable to a small, medium or large-sized refrigeration or air-conditioning system, and can replace the currently used orifice or electronic expansion apparatus. Besides, the refrigerant floating expansion apparatus of the invention precisely controls the flow of the fluid without using any electronic element, not only providing excellent controllability and benefit but also reducing the manufacturing cost of the apparatus.

According to a first aspect of the present invention, a refrigerant floating expansion apparatus including a main body, a standpipe, a float element and a separation element is provided. The main body includes a base plate and a pipe-shaped housing. The base plate is connected to the pipe-shaped housing and opposite to a first pipe opening of the pipe-shaped housing. The base plate has a first through hole and several second through holes. A high-pressure fluid entering the main body via the first pipe opening. The standpipe is fixed on the base plate. The standpipe has a second pipe opening and a third pipe opening, wherein the second pipe opening is connected to the first through hole, and each of the second through holes on the base plate is outside the connection between the standpipe and the base plate. The pipe wall of the standpipe has at least an opening near the second pipe opening. The float element surrounds the standpipe for controlling a fluid-passing area of the standpipe. When the float element is positioned at the bottom of the standpipe, a gap is formed between the float element and the base plate to keep the second through hole passable. The separation element surrounding the float element is disposed on the base plate to avoid the high-pressure fluid flowing to the top surface of the float element. The separation element forms an inner path with the pipe-shaped housing, and the separation element has several fluid passageways near the base plate. A high-pressure fluid is guided to pass through the fluid passageways along the inner path to move the float element for controlling the fluid-passing area of the opening. Afterwards, the high-pressure fluid is transferred to a low-pressure fluid by exiting the main body from the second through holes directly and by entering the opening of the standpipe then exiting from the first through holes.

The invention will become apparent from the following detailed description of the preferred but non-limiting embodiments. The following description is made with reference to the accompanying drawings.

DETAILED DESCRIPTION OF THE INVENTION

Figure 1:
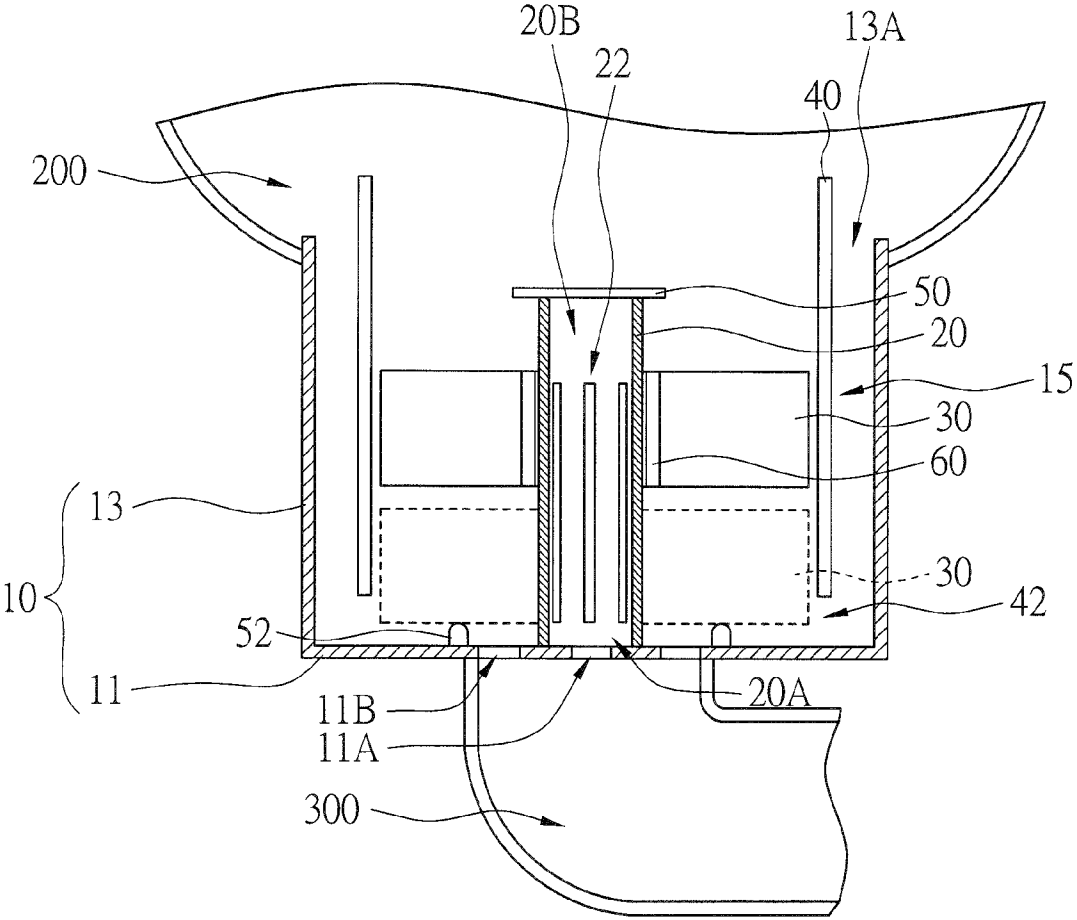
FIG. 1 is a diagram showing a refrigerant floating expansion apparatus according to a preferred embodiment of the invention.
Figure 2:
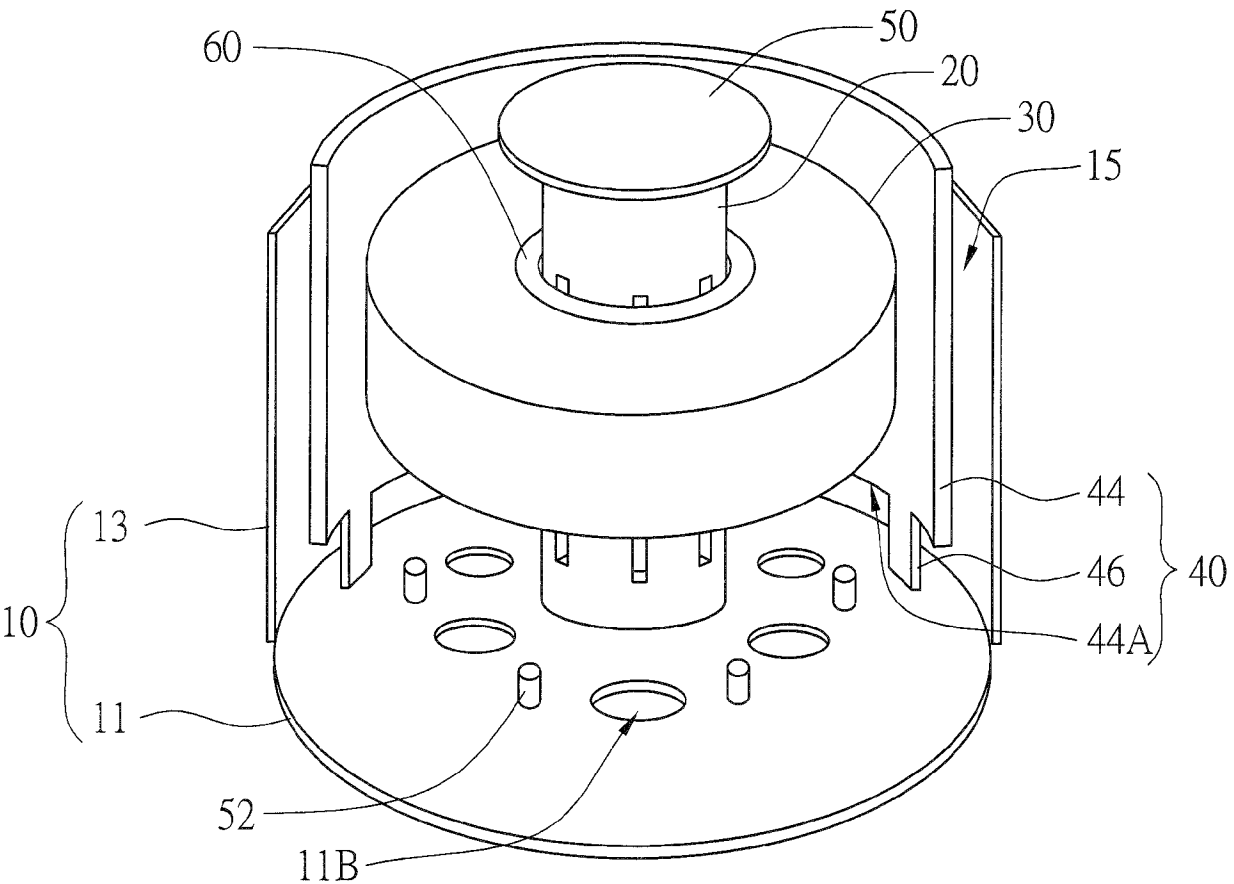
FIG. 2 is a 3-D diagram of the refrigerant floating expansion apparatus in FIG. 1.

FIG. 1 is a diagram showing a refrigerant floating expansion apparatus according to a preferred embodiment of the invention. FIG. 2 is a 3-D diagram of the refrigerant floating expansion apparatus in FIG. 1. The refrigerant floating expansion apparatus 1 includes a main body 10, a standpipe 20, a float element 30 and a separation element 40. The main body 10 includes a base plate 11 and a pipe-shaped housing 13. The base plate 11 is connected to the pipe-shaped housing 13 and opposite to a first pipe opening 13A of the pipe-shaped housing 13. The base plate 11 has a first through hole 11A and several second through holes 11B. The standpipe 20 is fixed on the base plate 11 and has a second pipe opening 20A and a third pipe opening 20B. The second pipe opening 20A is connected to the first through hole 11A, and each of the second through holes 11B on the base plate 11 is outside the connection between the standpipe 20 and the base plate 11. In addition, the standpipe 20 has at least an opening 22 on its pipe wall near the second pipe opening 20A.

The float element 30 surrounds the standpipe 20 for controlling a fluid-passing area of the opening 22 of the standpipe 20. When the float element 30 is positioned at the bottom of the standpipe 20, there is a gap formed between the float element 30 and the base plate 11 to keep the second through hole 11B passable. The separation element 40 surrounding the float element 30 is disposed on the base plate 11 to avoid the high-pressure fluid flowing to the top surface of the float element 30. The separation element 40 forms an inner path 15 with the pipe-shaped housing 13 and has several fluid passageways 42 near the base plate 11.

Of the refrigerant floating expansion apparatus 1 in the present embodiment of the invention, the first pipe opening 13A of the pipe-shaped housing 13 is, for example, connected to a fluid exit 200 of a condenser, and the first through hole 11A and the second through holes 11B of the base plate 11 are, for example, connected to a fluid entrance 300 of an evaporator or an energy saver. A high-pressure fluid such as high-pressure fluidic refrigerant flowing from the condenser enters the main body 10 via the first pipe opening 13A. The high-pressure fluid is guided to pass through the fluid passageways 42 along the inner path 15 to move the float element 30 for controlling the fluid-passing area of the opening 22. Afterwards, the high-pressure fluid exits the main body 10 by the second through holes 11B directly and by first entering the opening 22 of the standpipe 20 then out from the first through hole 11A, so as to expend its volume, thus the high-pressure fluid is transferred to a low-pressure fluid.

As shown in FIG. 1, the first through hole 11A of the base plate 11 is positioned at the center of the base plate 11. As shown in FIG. 2, the second through holes 11B preferably surround the first through hole 11A at equal distance. Preferably, the first through hole 11A and the second through holes 11B are circular.

The standpipe 20 is preferably circular and fixed on the base plate 11. The opening 22 of the standpipe 20 is preferably strip-shaped, and the extending direction of the opening 22 is the same as that of the standpipe 20. The float element 30 moves up and down with the fluid so that the opening 22 of the standpipe 20 is covered up, partially or totally exposed at different positions. The strip-shaped opening 22 enables the float element 30 to linearly adjust the flow of the fluid. Moreover, the length of the opening 22 in the extending direction of the standpipe 20 is greater than the height of the float element 30.

Although the opening 22 of the standpipe 20 is exemplified by a strip-shaped opening, the opening 22 can also be formed in other geometric shapes. In addition, the opening 22 is formed on the pipe wall of the standpipe 20, but the opening 22 can also be extended to the second pipe opening 20A. Thus, as long as the float element 30 moves upwards, the opening 22 will be exposed to increase the flow of the fluid.

As shown in FIG. 2, the separation element 40 includes a ring-shaped separation plate 44 and several supporting element 46. The supporting elements 46 are respectively connected to the lower edge 44A of the ring-shaped separation plate 44 and are engaged with the base plate 11. The fluid passageways 42 (shown in FIG. 1) are formed among the supporting elements 46, the lower edge 44A and the base plate 11. As shown in FIG. 1, the height of the separation element 40 is greater than that of the pipe-shaped housing 13 and that of the standpipe 20 to avoid the high-pressure fluid directly hitting the top surface of the float element 30 and blocking the movement of the float element 30.

The refrigerant expansion apparatus 1 includes a stopping element disposed at the third pipe opening 20B of the standpipe 20 to avoid the float element 30 coming off the standpipe 20. The stopping element is exemplified by a stopping plate 50. The stopping plate 50 is disposed at the third pipe opening 20B. Preferably, the area of the stopping plate 50 is larger than that of the third pipe opening 20B. Thus, the stopping plate 50 not only avoids the float element 30 moving upward and coming off the standpipe 20 but also seals the third pipe opening 20B of the standpipe 20 to avoid the refrigerant gas entering the standpipe 20.

In order to keep the second through hole 11B passable, the refrigerant expansion apparatus 1 has other stopping elements on the base plate 11 to avoid the bottom surface of the float element 30 being in contact with the base plate 11 seamlessly. In the present embodiment of the invention, several stopping blocks 52 are disposed on the base plate 11. When the flow is so small that the float element 30 is at the bottom of the standpipe 20, the stopping block 52 keeps a gap between the float element 30 and the base plate 11, thus the fluid still can exit the main body 10 via the second through holes 11B and the basic flowing state of the fluid is maintained.

Figure 3:
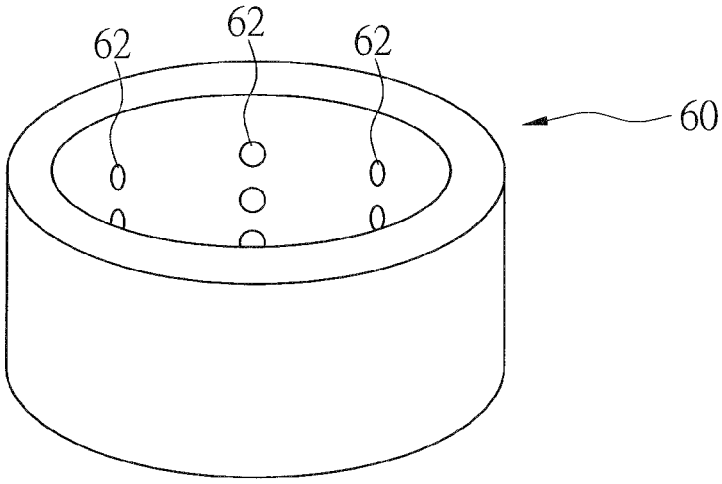
FIG. 3 is a diagram showing a ball bearing.

The refrigerant expansion apparatus 1 further includes a sliding element 60 for enabling the float element 30 to slide on the standpipe 20 smoothly. The sliding element 60 is disposed between an inner ring surface of the float element 30 and the standpipe 20. The sliding element 60 can be a ball bearing, a roller bearing or a sleeve bearing. In the present embodiment of the invention, the sliding element 60 is, for example, a ball bearing as shown in FIG. 3. The ball bearing has several rows of balls 62 for contacting with the standpipe 20, so that the contacting area between the float element 30 and the standpipe 20 is reduced to a minimum. Thus, the friction between the float element 30 and the standpipe 20 is minimized. Moreover, although the fluid may generate asymmetric force around the float element 30, the float element 30 does not seize up when sliding on the standpipe 20.

Figure 4:
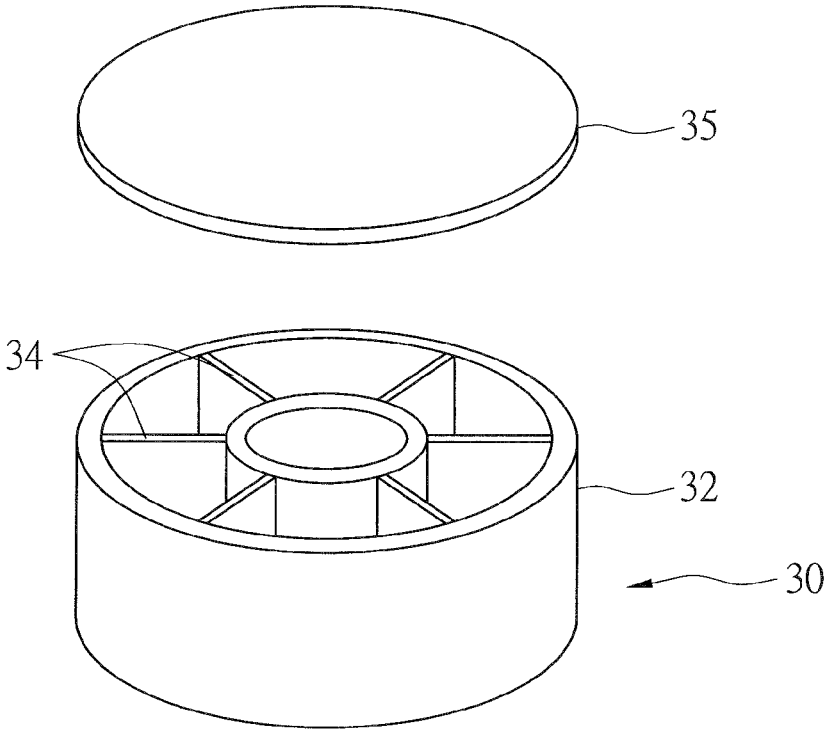
FIG. 4 is a diagram showing the float element in FIG. 1.

FIG. 4 is a diagram showing the float element in FIG. 1. The float element 30 includes a ring-shaped housing 32, several separation plates 34 and two round plates 35 (only one round plate 35 is shown due to the view angle restriction). Preferably, the separation plates 34 are disposed in the ring-shaped housing 32 at equal distance to enhance the structural strength of the float element 30, so as to bear the impact of the high-pressure fluid. The ring-shaped housing 32 and the separation plate 34 can be made from stainless steel to effectively enhance the structural strength of the float element 30.

Figure 5A:
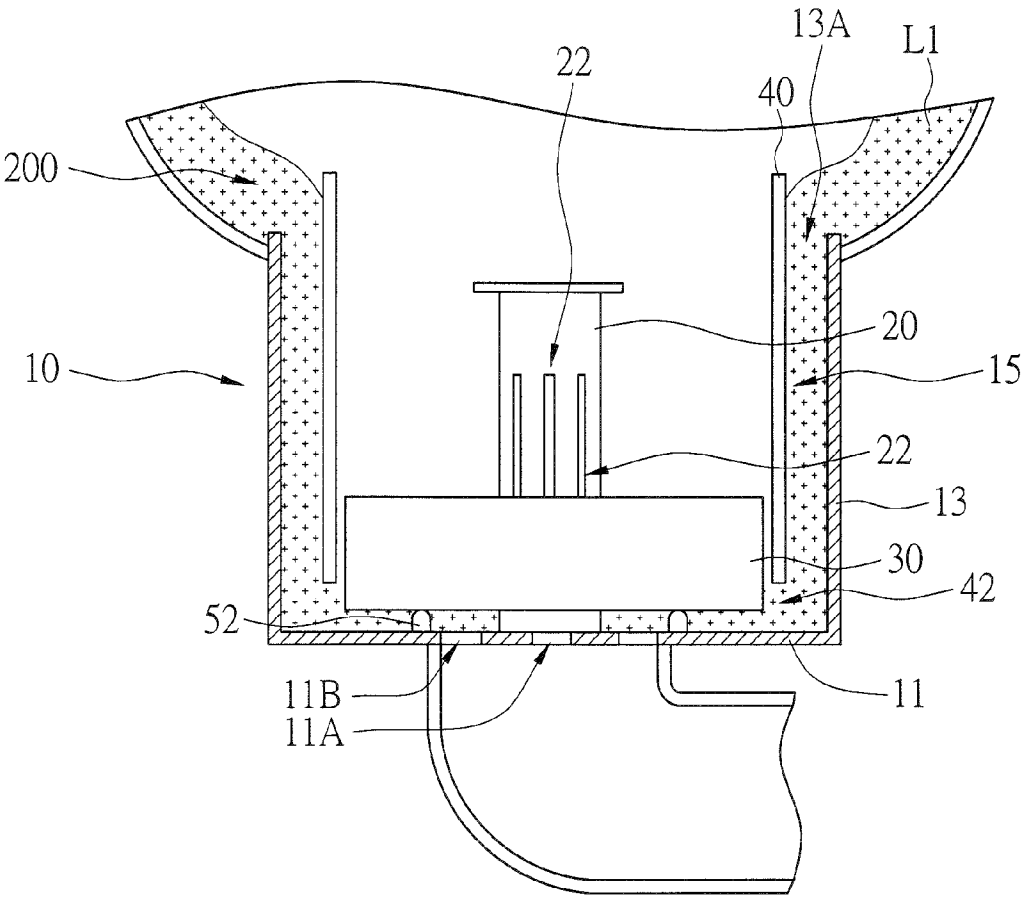
FIGS. 5A and 5B are diagrams showing the refrigerant expansion apparatus in FIG. 1 in operation.
Figure 5B:
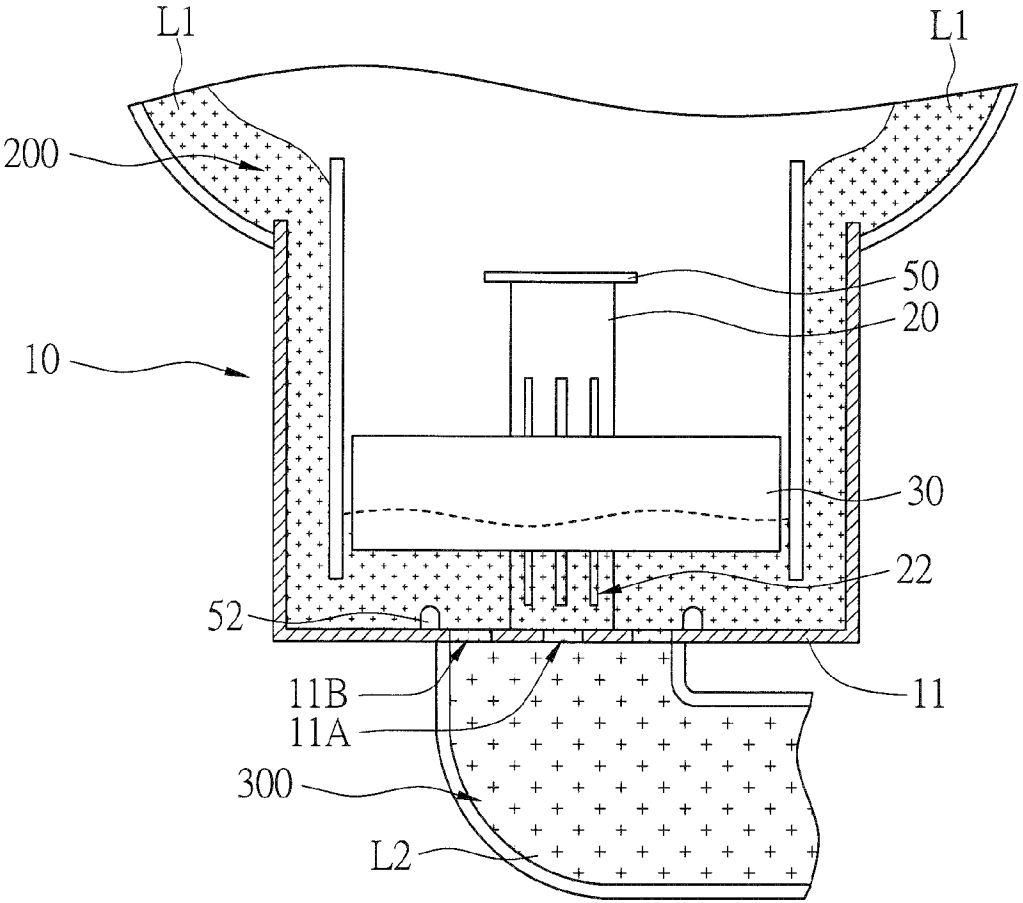

FIGS. 5A~5B are diagrams showing the refrigerant expansion apparatus in FIG. 1 in operation. In FIG. 5A, the high-pressure fluid L1 (such as a high-pressure fluidic refrigerant) entering the main body 10 via the first pipe opening 13A moves along the inner path 15 between the separation element 40 and the pipe-shaped housing 13 and then is guided to the fluid passageways 42. Meanwhile, although the lower portion of the opening 22 is completely covered up by the float element 30, the high-pressure fluid L1 still can exit the main body 10 via the second through holes 11B. Owing to the stopping blocks 52 that keep a gap between the float element 30 and the base plate 11, the impact of the high-pressure fluid is transmitted to the bottom surface of the float element 30 to generate an upward pushing force for lifting up the float element 30, so that the float element 30 can float with the fluid. As shown in FIG. 5B, when the float element 30 moves upwards, the opening 22 of the standpipe 20 is gradually exposed in response to the increasing amount of the high-pressure fluid. Meanwhile, apart from the second through hole 11B, the high-pressure fluid L1 also exits the main body 10 from the first through hole 11A after entering the inner hole of the standpipe 20 via the opening 22. As the high-pressure fluid L1 exits the main body 10, it expands and its pressure is reduced accordingly, the high-pressure fluid L1 is thus transferred to a low-pressure fluid L2. When the high-pressure fluid has large amount to push the float element 30 upward to the highest position, the stopping plate 50 avoids the float element 30 coming off the standpipe 20.

In the present embodiment of the invention, the stopping blocks 52 are used to keep a gap between the float element 30 and the base plate 11 for maintaining the basic flow of the fluid, but the invention is not limited thereto.

Figure 6:
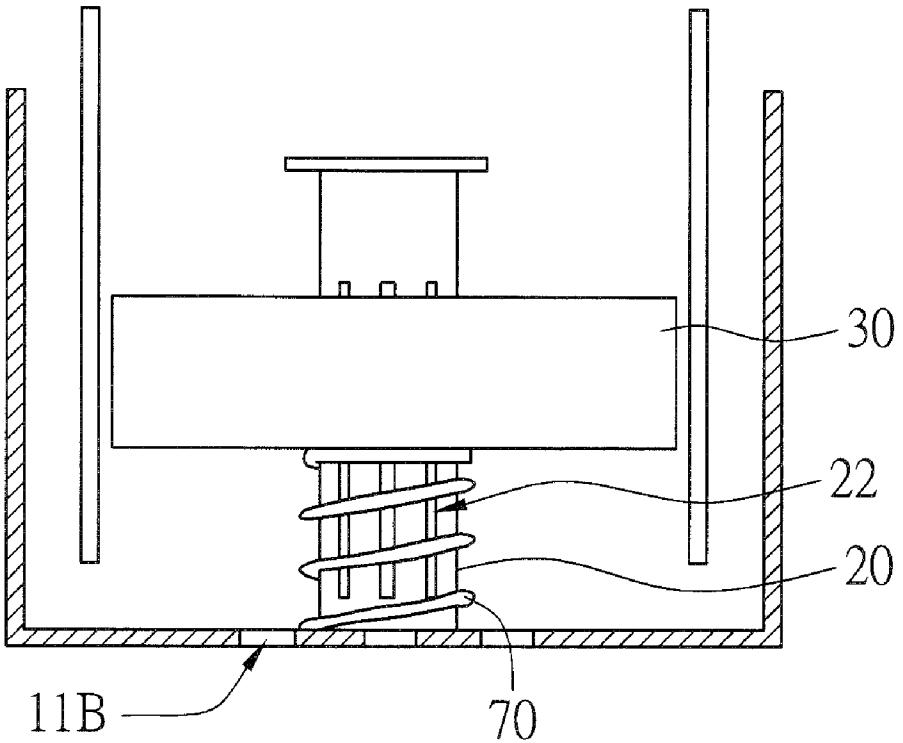
FIG. 6 is a diagram showing an elastic element keeps a gap between the float element and the base plate.

FIG. 6 is a diagram showing an elastic element keeps a gap between the float element and the base plate. At least an elastic element 70 is disposed between the base plate 11 and the float element 30. The elastic element 70 has certain length and can be used for keeping the gap between the base plate 11 and the float element 30 without disposing any stopping blocks 52 (shown in FIG. 1) on the base plate 11. The inertia weight of the float element 30 and the sliding element 60 can be calculated beforehand, and then a suitable elastic element 70 is selected to offset the inertia weight, so as to increase the accuracy of the float element 30 when adjusting the opening 22. The elastic element 70 can be a spring, a combination of several springs, or a pre-pressed spring sheet. The elastic element 70 in FIG. 6 is exemplified by a spring that surrounds the standpipe 20.

Figure 7:
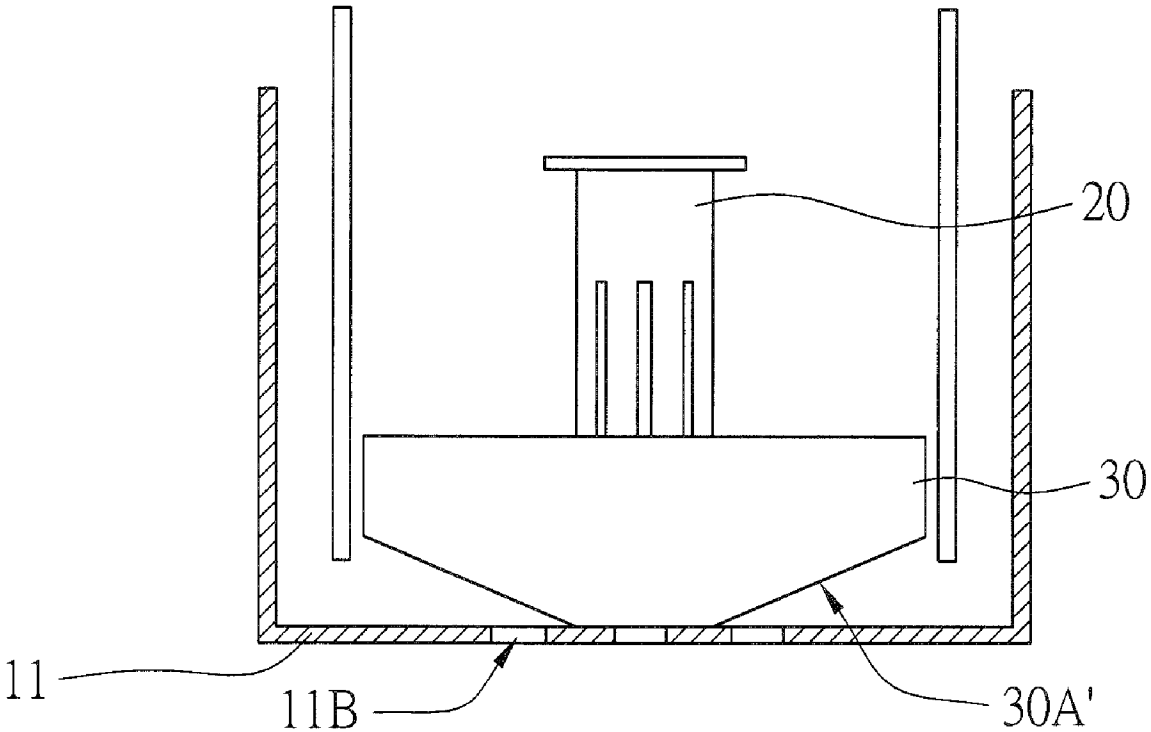
FIG. 7 is a diagram showing the float element has a cone-shaped bottom surface.
Figure 8:
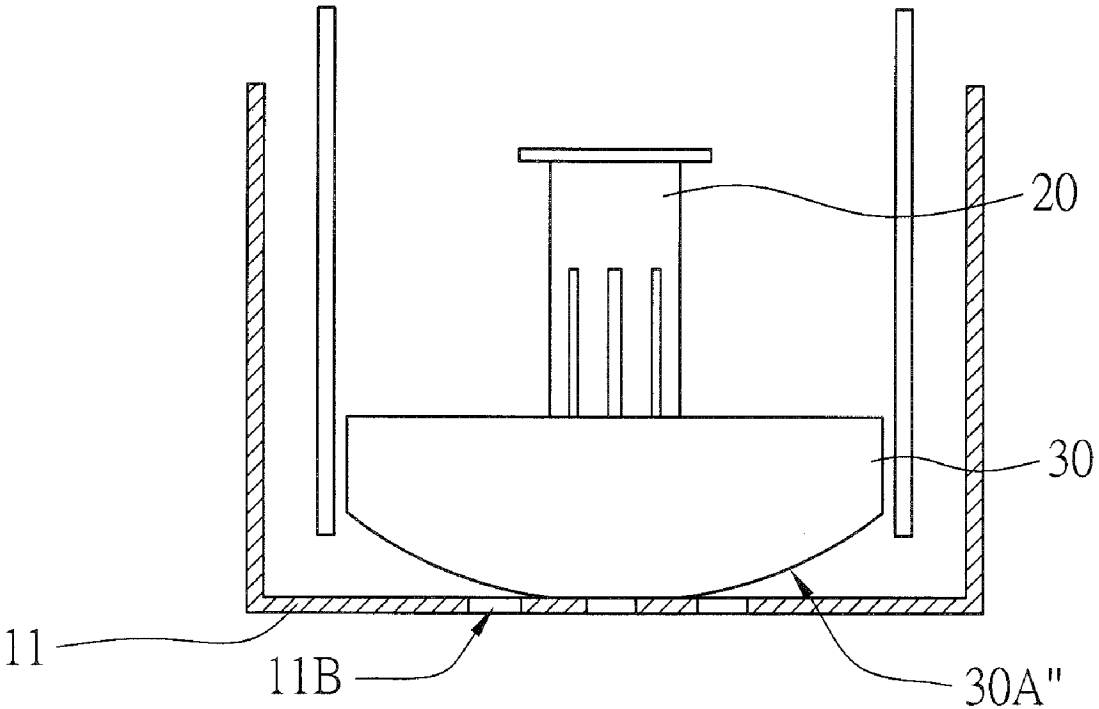
FIG. 8 is a diagram showing the float element has an arc-shaped bottom surface.

To maintain the basic flow of the fluid, the bottom surface of float element 30 can be designed to be non-smooth, so that the float element 30 will not be entirely in contact with the base plate 11. FIG. 7 is a diagram showing the float element has a cone-shaped bottom surface. FIG. 8 is a diagram showing the float element has an arc-shaped bottom surface. As shown in FIG. 7, the bottom surface 30A' of the float element 30 is conic, so that a gap exists between the float element 30 and the base plate 11 as the float element 30 is positioned at the bottom of the standpipe 20, hence leaving out the stopping blocks 52 (shown in FIG. 1). The force of the high-pressure fluid still can be transferred to the bottom surface of the cone of the float element 30, so as to form an upward pushing force to lift up the float element 30 to float. As shown in FIG. 8, the bottom surface 30A" of the float element 30 is arc-shaped and still have the same effect. In addition, the float element 30 can also be a ring-shaped round pipe.

According to the refrigerant floating expansion apparatus disclosed in the above embodiments of the invention, a float element surrounds a standpipe that has an opening, and the float element slides up and down according to the fluid flow, so as to cover or open the opening of the standpipe, thereby adjusting the flow amount of the fluid exiting the expansion apparatus. Since there is a separation element surrounding the float element, not only avoiding the high-pressure fluid directly hitting the top surface of the float element and blocking the floating of the float element, but also guiding the high-pressure fluid to a lower position then to contact with the float element. When the surface of the high-pressure fluid is too low, the high-pressure fluid still can exit via the through hole of the base plate, not only maintaining the basic flowing status of the fluid but further generating an upward force from the bottom of the float element to offset the inertia weight of the float element, so that the float element is capable of moving smoothly.

The refrigerant floating expansion apparatus disclosed in the above embodiments of the invention can be installed in a small, medium or large-sized refrigeration or air-conditioning system, and can replace the currently used orifice or electronic expansion apparatus. Particularly when used in a large-sized refrigeration system, the refrigerant floating expansion apparatus of the invention resolves the conventional problem of lacking suitable expansion apparatus. Besides, the refrigerant floating expansion apparatus of the invention precisely controls the flow of the fluid without using any electronic element, not only providing excellent controllability and benefit but also reducing the manufacturing cost of the apparatus, hence meeting the needs of many system manufacturers.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A refrigerant floating expansion apparatus, comprising:

a main body having a base plate and a pipe-shaped housing, wherein the base plate is connected to the pipe-shaped housing and opposite to a first pipe opening of the pipe-shaped housing, the base plate has a first through hole and a plurality of second through holes, and a high-pressure fluid enters the main body via the first pipe opening;

a standpipe fixed on the base plate, wherein the standpipe has a second pipe opening and a third pipe opening, the second pipe opening is connected to the first through hole, the second through holes of the base plate are outside the connection between the standpipe and the base plate, and the pipe wall of the standpipe has at least an opening near the second pipe opening;

a float element surrounding the standpipe for controlling a fluid-passing area of the opening on the standpipe, wherein when the float element is positioned at the bottom of the standpipe, a gap is formed between the float element and the base plate to keep the second through holes passable; and a separation element surrounding the float element and disposed on the base plate for avoiding the high-pressure fluid flowing to the top surface of the float element, wherein, the separation element and the pipe-shaped housing form an inner path, and the separation element has a plurality of fluid passageways near the base plate;

wherein, the high-pressure fluid is guided to pass through the fluid passageways along the inner path to move the float element for controlling the fluid-passing area of the opening, and the high-pressure fluid is transferred to a low-pressure fluid by exiting the main body from the second through holes directly and by entering the opening of the standpipe then exiting from the first through holes.

2. The refrigerant floating expansion apparatus according to claim 1, further comprising:

a stopping element disposed at the third pipe opening of the standpipe to avoid the float element coming off the standpipe.

3. The refrigerant floating expansion apparatus according to claim 1, further comprising:

at least a stopping element disposed on the base plate to avoid the bottom surface of the float element being in contact with the base plate seamlessly.

4. The refrigerant floating expansion apparatus according to claim 1, further comprising:

an elastic element disposed between the base plate and the float element to avoid the bottom surface of the float element being entirely in contact with the base plate.

5. The refrigerant floating expansion apparatus according to claim 1, wherein the float element has an inner ring surface and an outer ring surface, the refrigerant expansion apparatus further comprises:

a sliding element disposed between the inner ring surface and the standpipe.

6. The refrigerant floating expansion apparatus according to claim 5, wherein the sliding element is a ball bearing, a roller bearing or a sleeve bearing.

7. The refrigerant floating expansion apparatus according to claim 1, wherein the float element comprises a ring-shaped housing.

8. The refrigerant floating expansion apparatus according to claim 7, wherein the float element further comprises a plurality of separation plates and two round plates, the separation plates are disposed in the ring-shaped housing at equal distance, and the two round plates are respectively disposed at the top and the bottom of the ring-shaped housing.

9. The refrigerant floating expansion apparatus according to claim 1, wherein the float element has a non-smooth bottom surface.

10. The refrigerant floating expansion apparatus according to claim 9, wherein the float element has a cone-shaped bottom surface.

11. The refrigerant floating expansion apparatus according to claim 9, wherein the float element has an arc-shaped bottom surface.

12. The refrigerant floating expansion apparatus according to claim 1, wherein the standpipe is a circular standpipe.

13. The refrigerant floating expansion apparatus according to claim 1, wherein the opening of the standpipe is strip-shaped and the extending direction of the opening is the same as that of the standpipe.

14. The refrigerant floating expansion apparatus according to claim 13, wherein the length of the opening in the extending direction of the standpipe is larger than the height of the float element.

15. The refrigerant floating expansion apparatus according to claim 1, wherein the separation element comprises:

a ring-shaped separation plate having a lower edge; and a plurality of supporting elements respectively connected to the lower edge of the ring-shaped separation plate, the supporting elements are engaged with the base plate, and the lower edge, the supporting elements and the base plate form the fluid passageways.

16. The refrigerant floating expansion apparatus according to claim 1, wherein the height of the separation element in the extending direction of the standpipe is greater than the height of the pipe-shaped housing and the height of the standpipe.

17. The refrigerant floating expansion apparatus according to claim 1, wherein the first through hole of the base plate is positioned at the center of the base plate, and the second through holes surround the first through hole at equal distance.

18. The refrigerant floating expansion apparatus according to claim 1, wherein the first through hole and the second through holes are circular.

19. The refrigerant floating expansion apparatus according to claim 1, wherein the first pipe opening of the pipe-shaped housing is connected to a fluid exit of a condenser.

20. The refrigerant floating expansion apparatus according to claim 1, wherein the first through hole and the second through holes of the base plate are connected to a fluid entrance of an evaporator or an energy saver.

* * * * *